US005611398A

United States Patent [19]

Duhn et al.

[11] Patent Number: 5,611,398

[45] Date of Patent: Mar. 18, 1997

[54] TWO-PIECE DRILLING FLANGE

[75] Inventors: Rex E. Duhn; William D. Chapman, both of Bakersfield, Calif.

[73] Assignee: Duhn Industries, Bakersfield, Calif.

[21] Appl. No.: 534,127

[22] Filed: Sep. 26, 1995

[51] Int. Cl.[6] ..... E21B 33/04

[52] U.S. Cl. ..... 166/75.11; 166/75.14; 166/85.3; 166/379; 285/3

[58] Field of Search ..... 166/75.14, 75.11, 166/85.3, 95.1, 338; 285/2, 3, 333, 334

[56] References Cited

U.S. PATENT DOCUMENTS

| | | | |
|---|---|---|---|
| 1,607,430 | 11/1926 | Brewster | 166/75.11 |
| 2,075,899 | 4/1937 | Humason . | |
| 2,220,359 | 11/1940 | Tschappat . | |
| 2,284,869 | 6/1942 | Hinderliter . | |
| 2,927,642 | 3/1960 | Meredith et al. | 166/75.11 |
| 3,435,895 | 4/1969 | Lee | 166/75.11 |
| 4,452,472 | 6/1984 | Crase | 285/3 |
| 4,541,490 | 7/1985 | Bigbie et al. | 166/379 |
| 4,923,006 | 5/1990 | Hartmann et al. | 166/75.14 X |
| 5,145,213 | 9/1992 | Marrison et al. | 285/3 X |

OTHER PUBLICATIONS

Brochure, Larkin Products, Inc., Drilling and Adapter Flanges, p. 15.

Brochure, Huber–Hercules Wellhead Accessories, p. 15.

*Primary Examiner*—Dennis L. Taylor

*Attorney, Agent, or Firm*—Christie, Parker & Hale, LLP

[57] ABSTRACT

This invention relates to a two-piece drilling flange which allows for the full engagement of a conventional casing head external thread (8-round thread) reducing thread wear. The two-piece drilling flange incorporates a flange-bushing piece and a drilling-flange piece. The flange-bushing piece is hand tightened on the 8-round thread so that the casing head end face protrudes beyond the bushing. The drilling-flange piece is threaded onto the flange-bushing piece until a highly reliable elastomeric radial seal makes tight contact with the casing head end face. The drilling-flange piece is then further tightened, exerting an upward force on the flange-bushing piece, ensuring the full engagement of the casing head 8-round thread by the flange-bushing piece internal thread. This tight thread fit reduces thread wear by preventing destructive movement between the threads, especially during the highly vibrating drilling process.

16 Claims, 2 Drawing Sheets

TWO-PIECE DRILLING FLANGE

FIELD OF THE INVENTION

This invention relates to a-two-piece drilling flange which fully engages the outer thread (also known as 8-round thread) of an oil well casing head, resulting in reduced 8-round thread wear.

BACKGROUND OF THE INVENTION

Drilling flanges provide an interface to well casing heads for mounting various equipment such as blow-out preventers. A conventional drilling flange is threaded onto the casing head until a shoulder within the drilling flange makes contact with the casing head end face. An elastomeric O-ring seals the drilling-flange/casing-head interface.

The standard 8-round thread used in oil wells is a tapered thread. Tapered threads are typically threaded together until the inner and outer tapers are tightly engaged to form a secure, and usually leak free, connection. However, the drilling flange is designed not to fully engage the casing head thread. The reason behind this design philosophy is that if the drilling flange inner thread were to fully engage the casing head outer thread prior to the formation of the tightly sealed casing head end face/drilling-flange interface, a tightly sealed interface would not result. Since the 8-round thread is not fully engaged, a sloppy thread fit exists between the drilling flange and the casing head. This allows for destructive movement of the threads during use, especially during the highly vibrating drilling process, resulting in the rapid wear of both threads. Another problem associated with conventional drilling flanges is undue wear on both the casing head and the drilling flange threads due to frequent installations and removals.

While the prior art discloses various systems for providing an interface to a well, including drilling flanges, none disclose a two-piece drilling flange with a technique for assuring a tight seal and for fully engaging the casing head 8-round thread, as described herein.

BRIEF SUMMARY OF THE INVENTION

This invention offers a technique for providing an interface to a well casing head to accommodate various equipment needed for well operations. This technique reduces the wear on the well casing head external thread (8-round thread) by allowing for the tight engagement of the casing head external thread. A two-piece drilling flange comprising an annular flange-bushing piece ("bushing") and a drilling-flange piece is used. The bushing has an internal tapered thread for engaging the 8-round thread and an external straight thread for engaging the drilling-flange-piece internal thread. The bushing is hand tightened on the casing head until the tapered threads are engaged. This occurs at an axial location below the casing head end face such that the casing head protrudes through the bushing. The drilling-flange piece has a flange, a shoulder, and an annular lip. The shoulder has a center opening of diameter equal to or smaller than the inner diameter of the casing head end face. The lip has the internal straight thread to engage the external thread of the bushing. As the drilling-flange piece is threaded onto the bushing, the lower face of the shoulder makes contact with the casing head end face. A seal on the lower face of the shoulder, facing in the axial direction, makes full circumferential contact with the casing head end face. As the drilling flange is further threaded, it exerts an upward force against the bushing. This forces the bushing inner thread against the 8-round thread, creating a tight thread fit.

DETAILED DESCRIPTION

Figure 1:
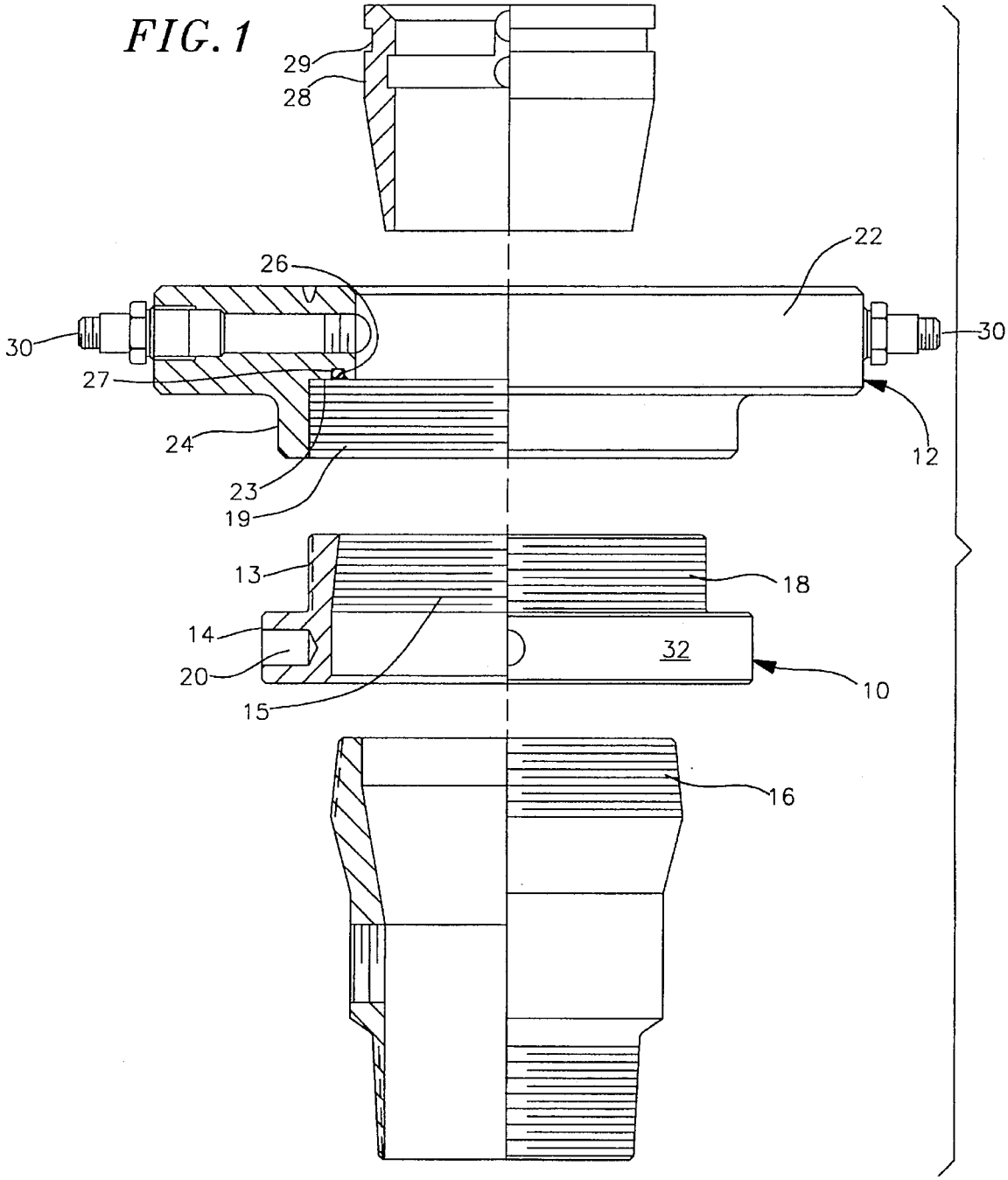
FIG. 1 is an exploded view of the two-piece drilling flange, the left half of which is in cross section. Also shown are the casing head and an optional wear bushing.
Figure 2:
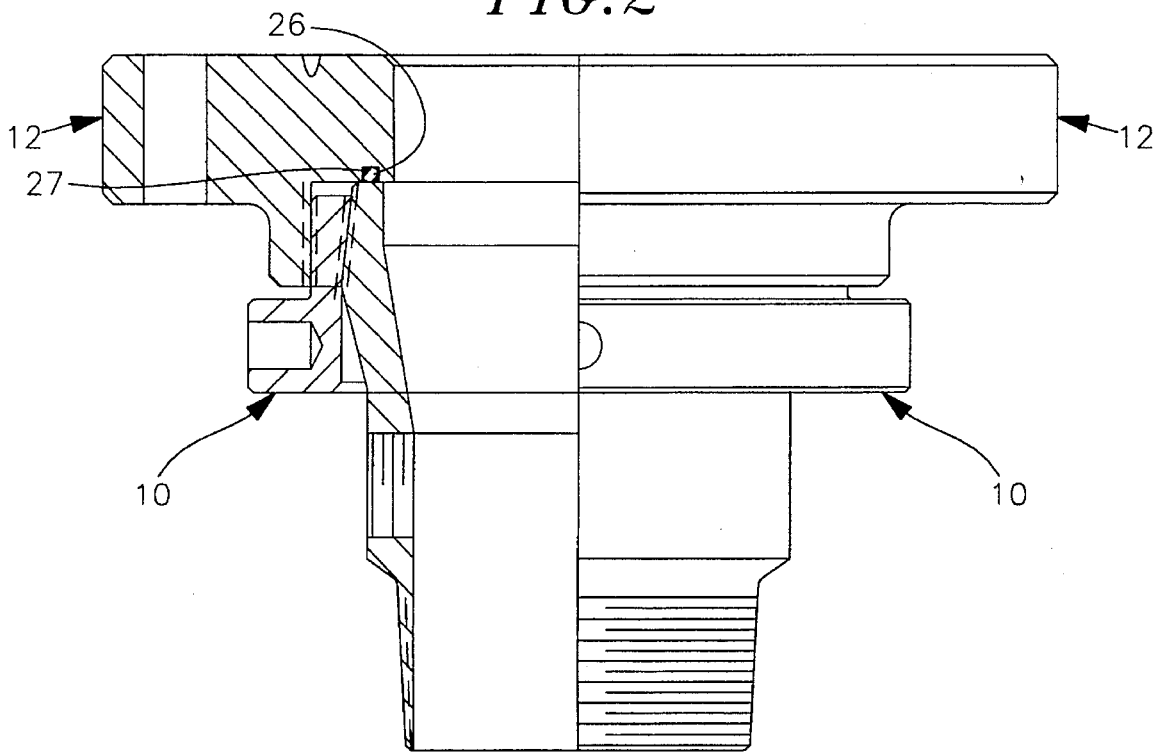
FIG. 2 is a view of the two-piece drilling flange assembled, with the left half shown in longitudinal cross section.

The present invention overcomes the problems associated with a conventional drilling flange by using a two-piece drilling flange. The two-piece drilling flange is composed of an annular flange-bushing piece ("bushing") 10 and a drilling-flange piece 12. The bushing generally comprises two integral sections: an upper section 13, and a lower flange section 14. The bushing upper section has an inner thread 15 to engage the casing head external thread 16 known as an 8-round thread. Typically, these threads are tapered. The bushing upper section also has an external thread 18 to engage an internal thread 19 of the drilling-flange piece. The bushing external thread and drilling-flange piece internal thread are typically acme threads. The bushing flange section does not have any external threads. Holes 20 are located on the bushing flange section's external perimeter. These holes are spaced around the perimeter to accommodate a spanner wrench to aid in the removal of the bushing from the casing head.

The drilling-flange piece is composed of an enlarged flange 22, an internal shoulder 23, and a lip 24. The lip is an annular axial extension from the flange. The lip has the internal thread 19 which engages the bushing external thread 18. The lip length may be limited to allow for the drilling-flange piece to be tightened against the bushing without making contact with the flange section 14 of the bushing. The enlarged flange extends radially outward from the lip. The shoulder extends radially inward from the enlarged flange, such that it forms an opening of diameter equal to or smaller than the internal diameter of the casing head end face. A highly reliable compression energized elastomeric circumferential face seal 26 is mounted in the shoulder and is positioned to make full contact with the circumference of the casing head end face when the drilling flange is completely threaded against the bushing. Preferably, the elastomeric seal is fitted in a groove 27 which is machined in the shoulder.

The bushing is hand tightened onto the casing head to an axial location below the casing head end face so that the casing head protrudes through the bushing. The drilling-flange piece is threaded onto the bushing beyond the point at which the elastomeric circumferential seal makes tight contact with the casing head end face. Up to the point of such contact, the threading torque drives the drilling-flange piece down the bushing length. Once contact is made preventing the drilling flange from further translating down the bushing length, the additional torque drives the bushing upwards. This additional torque forces the bushing internal thread against the casing head 8-round thread, removing any slack between these threads. A tight fit between the threads is formed, reducing thread wear due to vibrations introduced during well operations, especially during the drilling process. In essence, the present technique allows the two-piece drilling flange to torque-up against the 8-round thread, not against a shoulder as with conventional drilling flanges.

The bushing internal thread is tapered to match the 8-round thread. The thread type incorporated on the bushing exterior and on the drilling-flange piece interior has a lower breakaway torque than the 8-round and the bushing internal threads. Preferably, an acme-type thread is incorporated. An acme thread also allows for tight threading and exhibits less wear than other thread forms. A lower breakaway torque can also be achieved with other non-tapered threads.

Having a lower breakaway torque thread on the exterior of the bushing allows for the removal of the drilling-flange piece without disengaging the bushing from the casing head, thereby reducing wear of the 8-round thread. If it needs to be removed, the bushing which was hand tightened on the casing head, can usually be removed by hand. A spanner wrench may be used if the bushing is overtightened or corrosion has locked it in place. In addition, since the bushing is separate from the drilling flange, installation is much easier. The light weight bushing offers the operator a good feel for proper thread engagement, reducing the chances of 8-round thread damage and cross threading. Another advantage of this technique is that the flange bushing is, in essence, a sacrificial piece. When it finally succumbs to wear, it can be replaced at a lower cost than the cost required to replace a conventional drilling flange.

The two-piece drilling flange can be provided with an optional wear bushing 28 which can be installed during the drilling operation. The wear bushing is an annular piece with an annular groove 29 located on its outer perimeter. The wear bushing can be secured onto the drilling flange by the use of lock screws 30 which penetrate radially through the drilling-flange piece flange, engaging the grooves located on the wear bushing's outer perimeter. Use of the wear bushing further enhances the longevity of the assembly by preventing kelly whipping.

While a preferred embodiment of the present invention has been described herein, there are other alternative embodiments that fall within the spirit of the present invention. For example, the flange section of the bushing can be made such that its external diameter is equal to the external diameter of the bushing upper section. Or, instead of having holes to accommodate a spanner wrench, the bushing flange section can have an external shape to accommodate other types of wrenches. In a further embodiment, the upper section and the flange section of the bushing can have the same external diameter with the same external thread spanning both their lengths. By having the same external diameter, the length of the drilling-flange piece is not limited by the potential of contact with the bushing-flange section. With this embodiment, holes may also be incorporated on the externally threaded flange section of the bushing, penetrating the threads, to accommodate a spanner wrench to aid in the removal of the bushing.

In addition, the flange of the drilling-flange piece can have various external diameters. In essence, the flange of the drilling-flange piece serves as the means for accommodating a wrench for torquing the drilling-flange piece on the bushing and for removing the drilling-flange piece from the bushing. As with the bushing-flange section, the drilling-flange piece flange can also be made of various external geometric shapes to accommodate different types of wrenches. In the alternative, holes can be spaced around the perimeter of this flange section to accommodate a spanner-type wrench. Also, in other embodiments, the bushing external thread and the drilling-flange piece internal thread can be non-tapered threads other than acme threads, as long as they have a lower breakaway torque requirement than the bushing internal thread.

Although more cumbersome, the internal thread on the drilling-flange piece and the external thread on the bushing could be reversed.

What is claimed is:

1. A two-piece drilling flange comprising: an annular flange-bushing piece comprising:

an internal thread matching the external thread on a conventional casing head, the casing head having an end face, and an external thread having a lower breakaway torque than the internal thread; and a drilling-flange piece comprising:

an internal thread matching the external thread, and a circumferential elastomeric seal facing in the axial direction of the internal thread and having a diameter smaller than the inside diameter of the flange-bushing piece for sealing against the end of a casing head.

2. A two-piece drilling flange as recited in claim 1 wherein the internal thread in the flange-bushing piece is a tapered thread.

3. A two-piece drilling flange as recited in claim 1 wherein the external thread on the flange-bushing piece and the internal thread on the drilling flange are non-tapered threads.

4. A two-piece drilling flange as recited in claim 3 wherein the external thread on the flange-bushing piece and the internal thread on the drilling flange are acme threads.

5. A two-piece drilling flange which engages a conventional well casing head to provide an interface for attachment of external well equipment, the casing head having an end face, comprising:

an annular flange-bushing piece, comprising:

an internal thread matching the external thread on a conventional casing head, and means for tightening the bushing at an axial location below the casing head end face; and a drilling-flange piece, comprising:

a shoulder, with a center opening on a common central axis with the casing head having an inner diameter equal to or smaller than the inner diameter of the casing head end face, which makes contact with the casing head end face, means on the shoulder for sealing the area of contact with the casing head end face, a flange extending radially outward from the shoulder, and an annular lip of larger inner diameter than the inner diameter of the shoulder, so that it can be threaded on the flange-bushing piece, comprising an internal thread matching the external thread on the flange-bushing piece, wherein the lip has an axial length that allows for tightening on the flange-bushing piece while allowing for a tight contact of the shoulder and sealing means with the casing head end face.

6. A two-piece drilling flange as recited in claim 5 wherein the means for providing a seal between the drilling flange and the end face of the casing head comprises a compression energized elastomeric circumferential seal positioned to fully engage the casing head end face.

7. A two-piece drilling flange as recited in claim 5 wherein the breakaway torque requirement of the drilling-flange piece is lower than the breakaway torque requirement of the flange-bushing piece.

8. A two-piece drilling flange as recited in claim 7 wherein the internal thread in the flange-bushing piece and the external thread of the conventional casing head are tapered threads.

9. A two-piece drilling flange as recited in claim 7 wherein the external thread on the flange-bushing piece and the internal thread on the drilling-flange piece are non-tapered threads.

10. A two-piece drilling flange as recited in claim 9 wherein the external thread on the flange-bushing piece and the internal thread on the drilling-flange piece are acme threads.

11. A two-piece drilling flange comprising:

a bushing having an internal tapered thread matching the external thread on a conventional casing head;

a drilling-flange piece, including a resilient face seal for sealing against the end of a conventional casing head; and means for drawing the drilling-flange piece and the bushing together for effectively simultaneously forcing the face seal downwardly against the end of a casing head and forcing the internal thread upwardly against the thread of the casing head.

12. A two-piece drilling flange as recited in claim 11 wherein the internal thread on the drilling-flange piece and the external thread on the bushing have a breakaway torque less than the breakaway torque of the internal thread on the bushing and the external thread on the casing head.

13. A two-piece drilling flange as recited in claim 11 wherein the means for drawing comprises a non-tapered thread on the bushing and a matching thread on the drilling-flange piece.

14. A two-piece drilling flange as recited in claim 13 wherein the non-tapered thread has a lower breakaway torque than the tapered thread.

15. A method for prolonging the life of a well casing head external thread which is engaged by a drilling flange, the casing head having an end face, the drilling flange comprising a flange-bushing piece with a tapered-internal thread and an external thread, and a drilling-flange piece with internal thread, comprising the steps of:

threading the flange bushing on the external thread;

threading the drilling flange on the bushing outer thread until the drilling flange makes contact with the end face of the casing head; and further threading the drilling flange for driving the bushing upwards against the outer thread removing any slack between the bushing and the thread of the casing head, thereby ensuring complete engagement of these threads and preventing any movement between the threads.

16. The method recited in claim 15, wherein the bushing is hand tightened on the casing head thread to a point below the end face of the casing head.

* * * * *